US005974979A

United States Patent [19]

Grady et al.

[11] Patent Number: 5,974,979

[45] Date of Patent: Nov. 2, 1999

[54] PORTABLE TABLES FOR MASSAGE AND PHYSICAL THERAPY

[76] Inventors: Kevin Mark Grady, 244 Justin Morrill Memorial Hwy., Strafford, Vt. 05072; Chris Tatum, 1631 SW. 170th St., Newberry, Fla. 32669

[21] Appl. No.: 09/100,012

[22] Filed: Jun. 19, 1998

[51] Int. Cl.[6] ..... A47B 3/00

[52] U.S. Cl. ..... 108/36; 108/123; 108/130

[58] Field of Search ..... 108/35, 33, 36, 108/153.1, 115, 123, 132, 129, 133, 131; 248/434, 174, 175, 176, 169, 173; 5/620, 621, 622, 627; 269/901

[56] References Cited

U.S. PATENT DOCUMENTS

| | | |
|---|---|---|
| 396,531 | 1/1889 | Boysen . |
| 1,181,320 | 5/1916 | Korn . |
| 1,446,917 | 2/1923 | McGrew . |
| 2,673,774 | 3/1954 | Di Prima . |
| 4,333,638 | 6/1982 | Gillotti . |
| 4,575,975 | 3/1986 | Eisenberg . |
| 4,833,998 | 5/1989 | Everett et al. . |
| 4,927,128 | 5/1990 | O'Brian . |
| 4,943,041 | 7/1990 | Romein . |
| 5,009,170 | 4/1991 | Spehar . |
| 5,335,676 | 8/1994 | O'Brien . |
| 5,524,555 | 6/1996 | Fanuzzi . |
| 5,676,062 | 10/1997 | Lloyd . |

OTHER PUBLICATIONS

Tatum Light product catalog, 4 pages.
Touch America product catalog, 8 pages.
Various advertisements for tables from *Massage* Magazine, Mar./Apr. 1996, Issue No. 60.

*Primary Examiner*—Jose V. Chen
*Attorney, Agent, or Firm*—Dowell & Dowell, P.C.

[57] ABSTRACT

Portable folding tables which are particularly adapted for massage and other body therapy uses wherein each table includes two top sections which are hingedly connected at one end and which are supported by legs which are pivotally connected thereto. Each leg is reinforced by either a longitudinal pivotally folding brace, a guide assembly or a positive stop member. The legs, and reinforcing braces when used, are automatically deployed and stabilized by cable systems which extend both longitudinally and diagonally relative to the table legs.

25 Claims, 9 Drawing Sheets

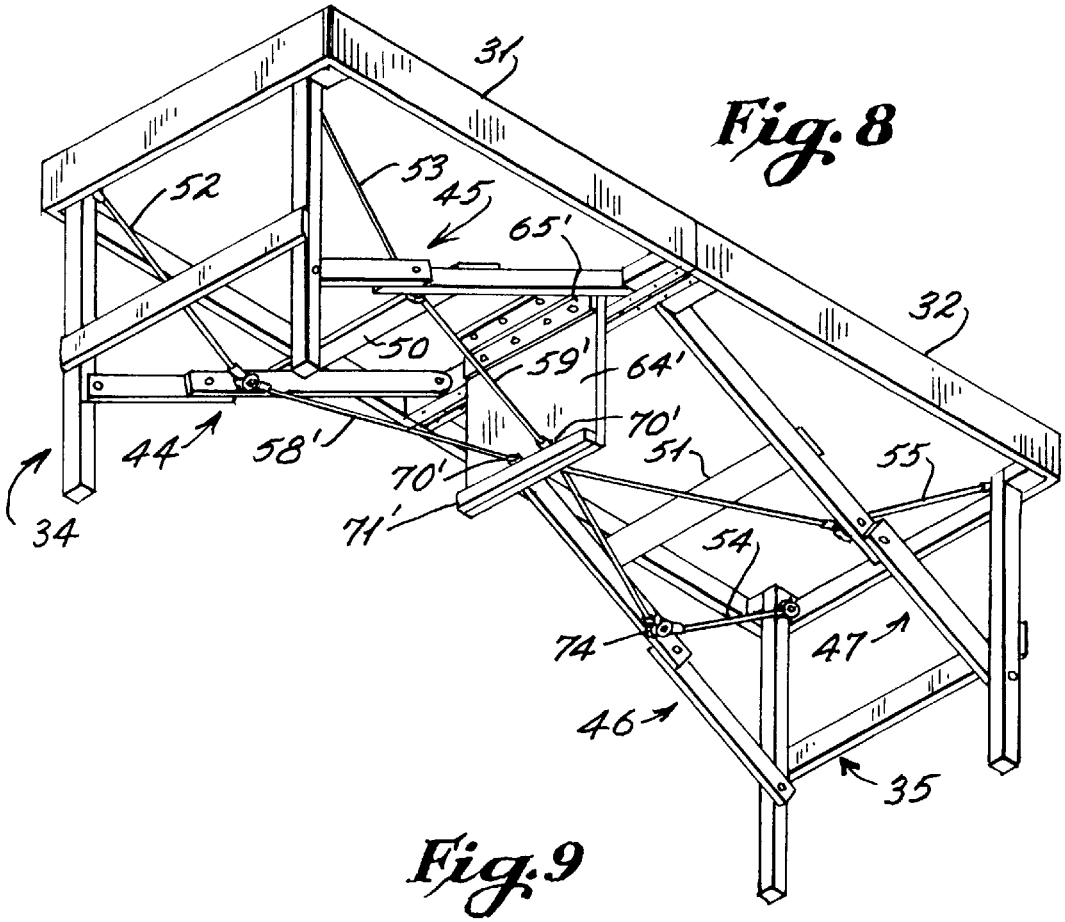
Fig. 8
Fig. 9
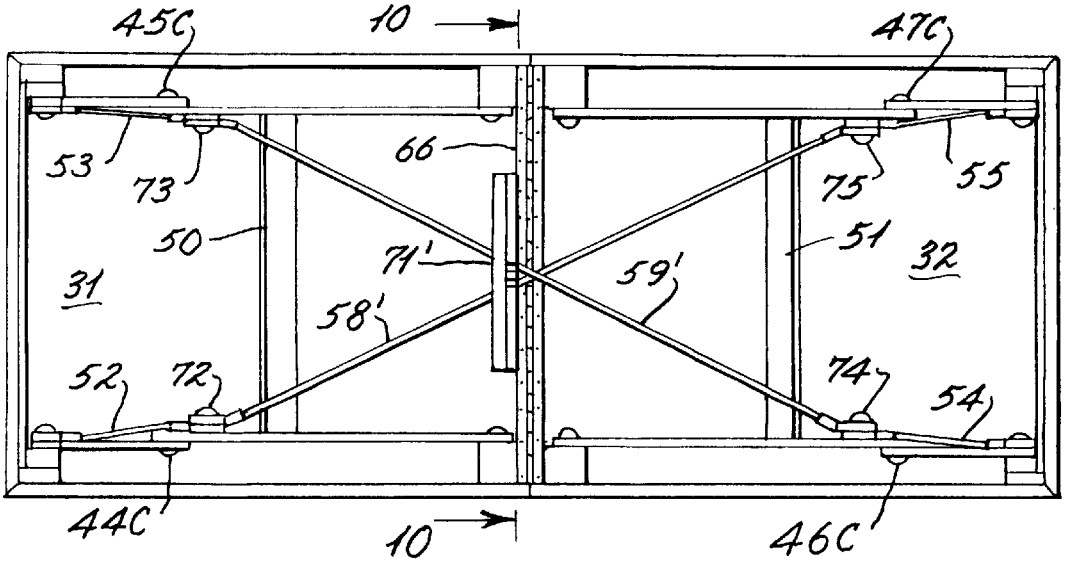

Fig.15
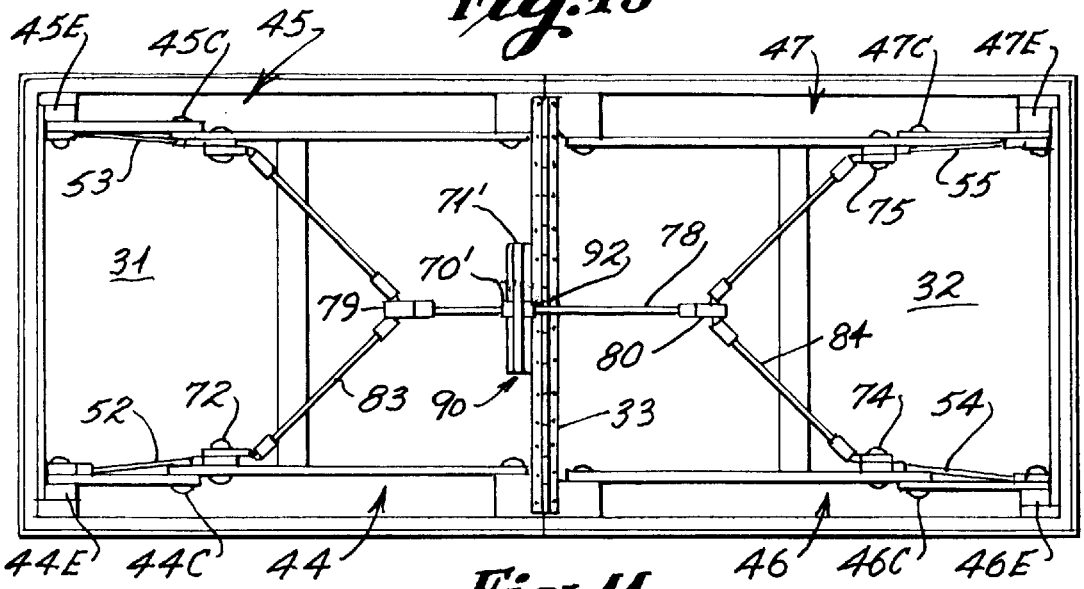
Fig.11
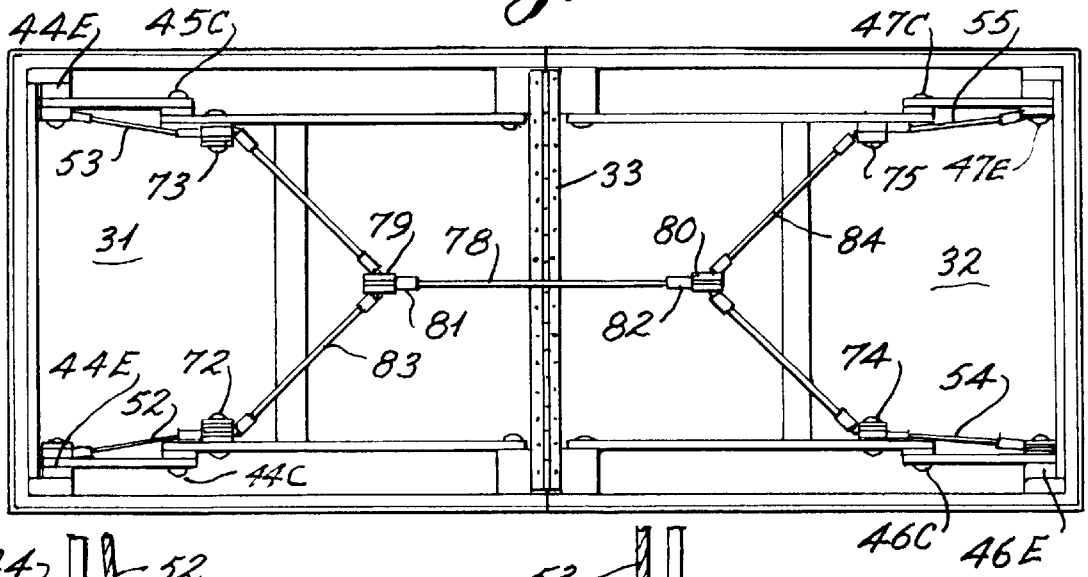
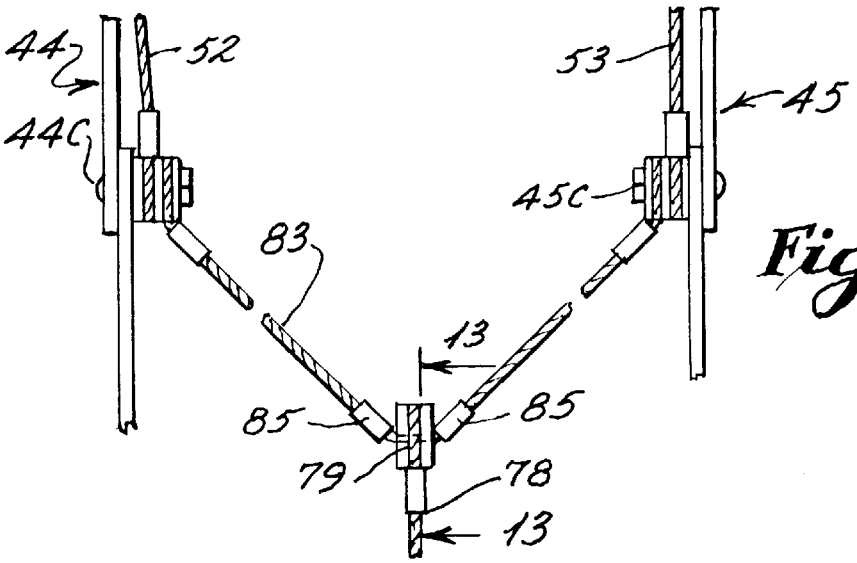
Fig.12

Fig.16
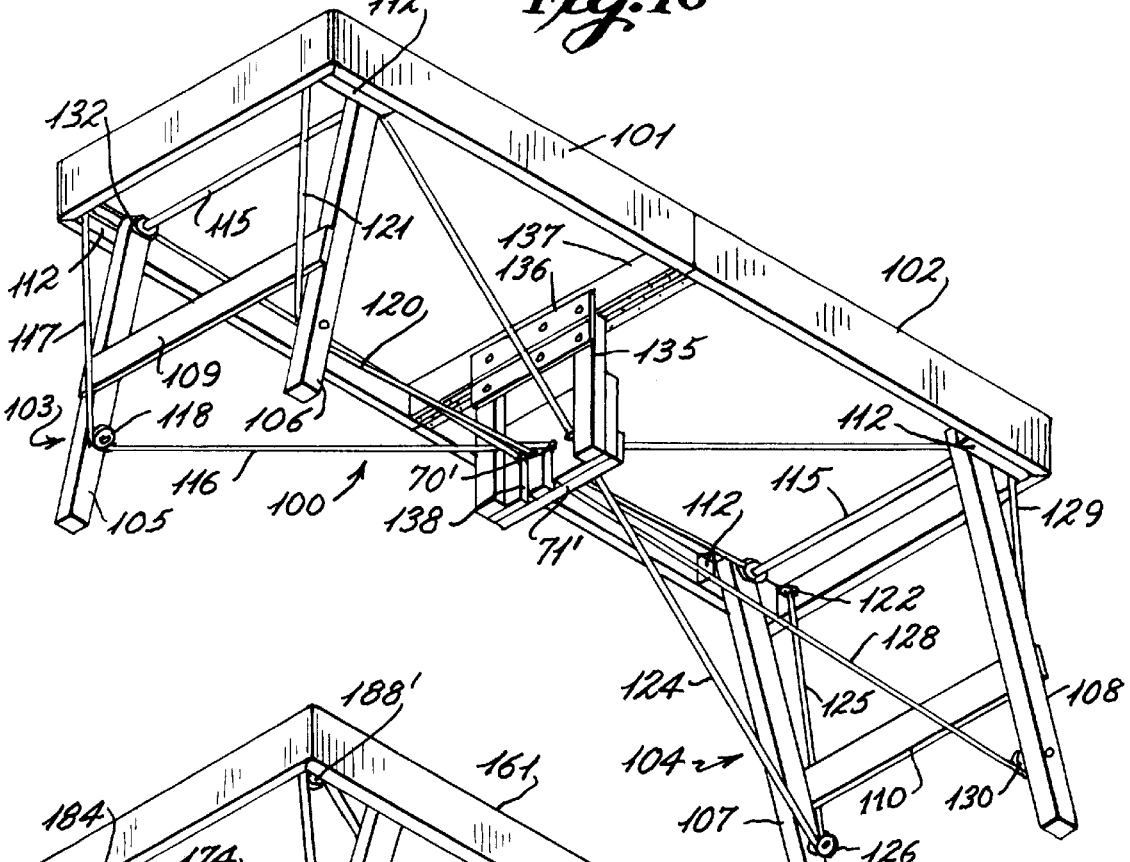
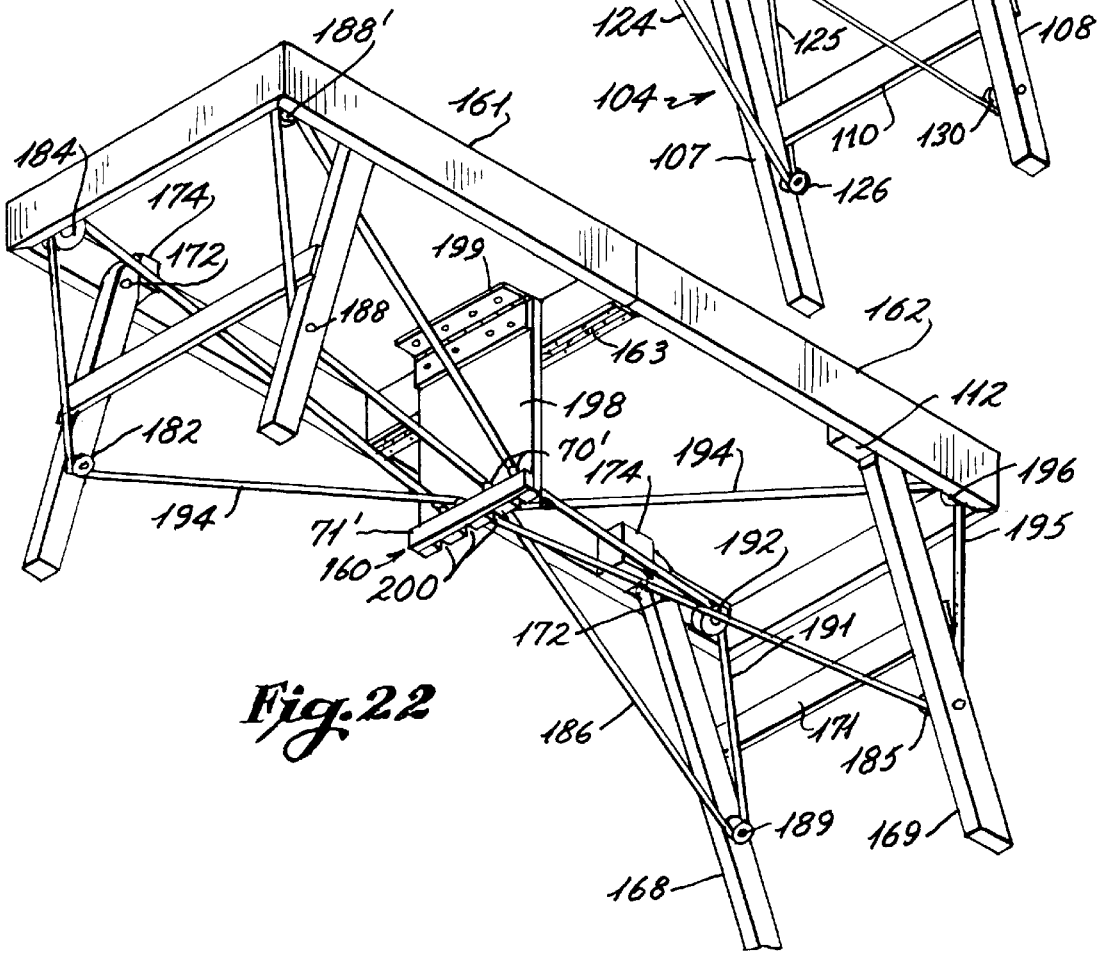
Fig.22

Fig.19
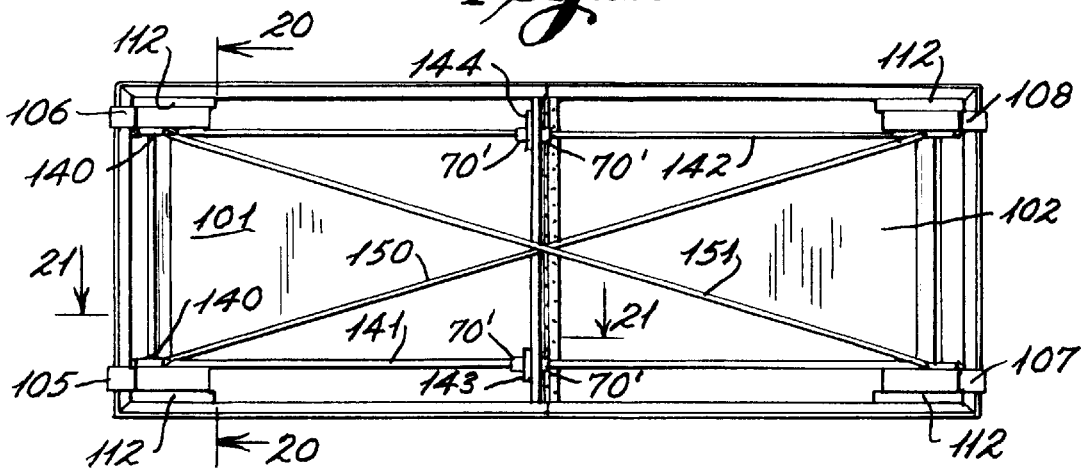
Fig.20
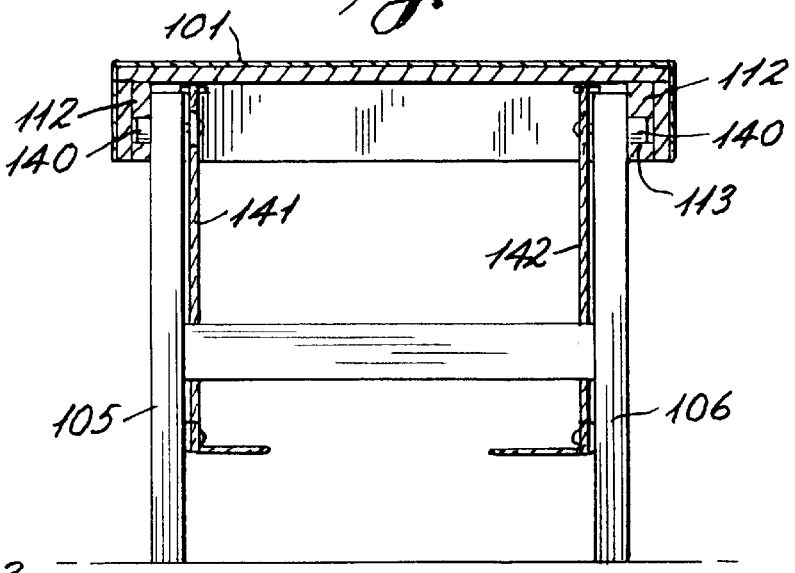
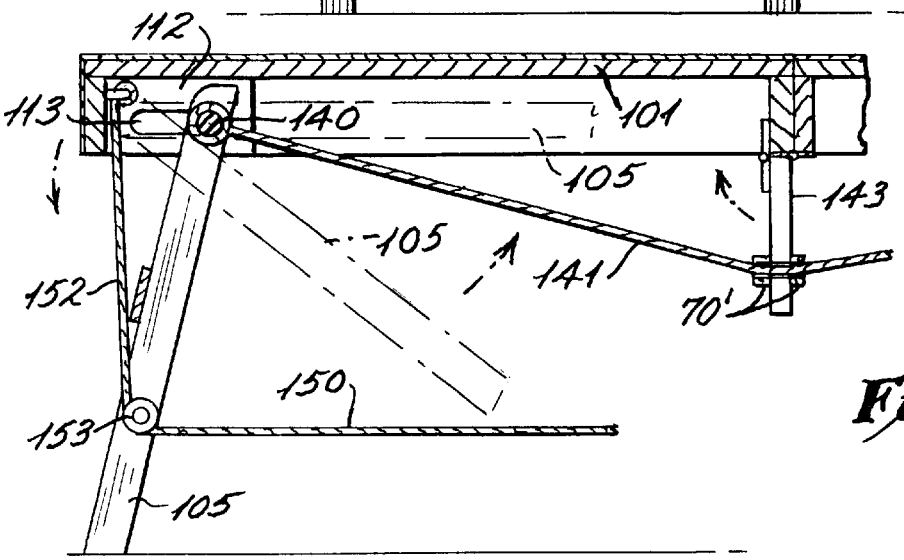
Fig.21

PORTABLE TABLES FOR MASSAGE AND PHYSICAL THERAPY

CROSS REFERENCES TO RELATED APPLICATIONS

None

STATEMENT AS TO RIGHTS TO INVENTIONS MADE UNDER FEDERALLY SPONSORED RESEARCH AND DEVELOPMENT

None

BACKGROUND OF THE INVENTION

The present invention is directed to portable tables of the type which are particularly adapted for use for massage and physical therapy and which include hingedly connected top sections which are supported by pivotal leg assemblies. The leg assemblies are designed to be collapsed into a stored position beneath the top sections so that the two top sections may be folded into a compact and portable configuration. Further, the present invention is directed to cable truss systems which automatically deploy the table leg assemblies when the top sections are unfolded relative to one another and the cables thereafter positively reinforcing and stabilizing the leg assemblies while providing maximum leg clearance beneath the tables.

Portable tables of the type which are utilized by massage and other body therapists not only must be lightweight to facilitate portability but also must be durable enough to provide a safe support for those receiving treatment. In this respect, in U.S. Pat. No. 4,333,638 to Gillotti, a massage worktable is disclosed which includes a reinforcing truss system incorporating cables, cords or wire ropes which connect each leg to an area adjacent a pivot joint of foldable tabletop sections with the cables extending generally parallel along each side of the table. Such a structure decreases the overall weight of the portable table, however, the truss design associated therewith is insufficient to provide adequate reinforcement to the table legs and further obstructs clearance for the practitioner beneath the table. A similar cable reinforcing structure is disclosed in U.S. Pat. No. 4,943,041 to Romein.

To further increase stability of foldable massage tables, U.S. Pat No. 4,833,998 to Everett et al. discloses providing pivotable leg braces for connecting each of the legs of a table to a point adjacent a hinge joint of the top sections of the table. With the Everett et al. structure, flexible cables are utilized to secure the upper portion of the legs adjacent their pivot point to an intermediate portion of an adjacent leg brace with the cables extending beneath additional cable supports that are mounted at the mid-point of the table such that the cables extend generally parallel with respect to one another along the opposite sides of the table. The leg braces associated with the Everett et al. structure provide increased rigidity, however, the cable system, like that of the cable system disclosed in Gillotti, requires that the cables extend along each of the elongated sides of the table in such as a manner as to possibly interfere with the movement of the practitioner about the table. Further, the cable system only provides rigidity lengthwise of the table but not laterally with respect to the length. Somewhat similar structures for cable trusses are disclosed in U.S. Pat. Nos. 5,009,170 to Spehar, 5,524,555 to Fanuzzi, and 5,676,062 to Lloyd.

Although many foldable therapeutic massage tables utilize reinforcing cable trusses that extend adjacent to and along the elongated sides of a table, U.S. Pat. No. 4,927,128 to O'Brian discloses a foldable massage table wherein the legs are reinforced by two sets of diagonal leg braces, one of which extends toward the center portion of the table and one which extends to a central portion of an adjacent end of the table. The cable system in the patent incorporates cables which extend diagonally between laterally oriented reinforcement braces provided adjacent each end of the table to a diagonally opposite leg of the table adjacent its upper pivot connection to the top section of the table. Although this type of cable system does provide some lateral stability and also provides for increased clearance beneath the top of the table when compared as to other portable massage tables, the cable truss reinforcement does not provide adequate stabilization in the area of the longitudinal braces associated with each leg.

In view of the foregoing, there remains a need to provide a lightweight portable massage or therapy table which incorporates cable reinforcing for the legs or leg assemblies which not only provides maximum clearance beneath the table, so as to not interfere with the practitioner, but also provides longitudinal and lateral rigidity for the leg or leg assemblies during use of the table.

SUMMARY OF THE INVENTION

The present invention is directed to portable tables which are particularly adapted for use for massage and other body therapy wherein the tables include top sections which are hingedly connected to one another and which are supported at their outer ends by pairs of legs or leg assemblies which are pivotable so as to be collapsed against the bottom of the top sections when the tables are folded into a compact configuration. In some embodiments, each table leg is reinforced by a longitudinal leg brace which extends from an intermediate portion of the leg upwardly to a pivot connection positioned toward the hinge joint of the table. Each longitudinal leg brace includes at least two members or segments which are pivotally connected along their length so as to be foldable into a side-by-side relationship when the legs are folded beneath the top sections.

In other embodiments of the present invention, the table legs are not reinforced by longitudinal brace members but are rather designed to be canted at an angle outwardly with respect to pivot connections by way of which the legs are secured to a top section of the table. The legs are automatically deployed and reinforced by cable truss systems. A variety of cable truss systems are also utilized which incorporate longitudinal leg braces. Each truss system includes cables which reinforce and stabilize a table diagonally from one end to the other to thereby enhance stability when in use. Further, each truss system includes cables or cable segments which extend from adjacent an upper portion of each leg downwardly to either a point along the length of the leg for purposes of reinforcement or downwardly to an area of a pivot connection between the at least two brace members in those embodiments incorporating brace members.

In a first embodiment, the diagonally oriented cables of the truss system extend from an area of the pivot connection between members or segments of each longitudinal leg brace diagonally and upwardly to an area of an upper end of a diagonally disposed leg at the opposite end of the table.

In a second embodiment, the diagonally extending cables of the cable truss system extend from adjacent to or at the pivot point of one leg brace assembly diagonally across the length of the table to adjacent to or at the pivot point of the brace assembly associated with a diagonally oriented leg.

In a third embodiment, each diagonal cable of the truss system extends from an area of the pivot connection between segments of each leg brace to a central cable which is generally parallel to the sides of the table. In this embodiment, the cables extending diagonally from the leg braces at each end of the table may be a single cable oriented in a somewhat V-shaped configuration through an intermediate connector at one end of the central cable.

In the first three embodiments, further reinforcing and automatic deployment of the cables and table legs may be facilitated by using an inverted truss structure mounted centrally of the table and extending downwardly therefrom through which the diagonal or central cables extend.

In accordance with a fourth embodiment of the present invention, the table legs are designed to be slidably mounted in channels provided in the upper corners of the top sections of the table. The legs are pivotally deployed as the upper ends thereof are moved away from the ends of the top sections within the channels such that the legs are canted outwardly along their length toward the lower portions thereof. In this embodiment, the legs engage the forward ends of the channels or guide tracks when the legs are fully deployed. In this embodiment, the diagonal truss system includes cables, each extending from an area of a corner of the top of the table downwardly to a point spaced along the adjacent leg and then diagonally beneath the table to an upper portion of a leg mounted at the opposite end of the table. The diagonal cables preferably extend through an inverted guide truss pivotally connected at the central portion of the table which serves to automatically deploy the cables as the table is unfolded from a collapsed compact configuration. With this configuration, the cable truss system will positively move the legs within their guide channels such that the legs are fully canted outwardly as the table achieves its fully unfolded configuration.

In a variation of the fourth embodiment, the diagonal cables of the truss system are connected adjacent the opposite end of the table as opposed to the opposite legs. In this embodiment, a pair of cables are provided which extend generally parallel to the sides of the table and are connected to the upper portion of each leg on each side of the table to one another with the cables passing through inverted guide trusses pivotally mounted to the bottom of the table. In this embodiment, as the table is unfolded, the parallel cables will automatically deploy the legs by pulling the legs toward the forward portion of the guide channels.

In a fifth embodiment of the present invention, each of the table legs is pivoted to a top section of the table from a fully collapsed or stowed position in which the leg may be enclosed between the top sections of the table when the table is folded to a fully deployed position wherein the upper portion of the leg abuts a stop element secured to the top section when the leg is canted outwardly relative to a vertical plane. The cable truss system of this embodiment includes a cable connected at an intermediate or lower portion of each leg which extends upwardly over a pulley or guide mechanism and then diagonally downwardly to an intermediate or lower portion of a leg mounted along the opposite side of the table. With this embodiment, the legs will automatically be deployed by an inverted guide truss through which the cables extend. The inverted guide truss is pivoted to the central portion of the table so that the truss moves from a horizontal position relative to a top section of the table to a perpendicular relationship with respect thereto when the table is fully deployed.

In a variation to the fifth embodiment, the cable truss system includes cables each of which extend from an area of an end corner of a top section of the table downwardly about a guide or pulley mechanism mounted to a portion of an adjacent leg and then diagonally beneath the table to an opposite corner of the table top where an opposite end of each cable is secured. In this embodiment, an inverted guide truss may also be utilized through which each cable passes such that the truss facilitates the positive deployment of the cables and table legs when being moved from a stowed to a fully open and deployed configuration. To provide a positive locking feature, each of the cables may include a stop member which engages the guide or pulley mechanism mounted to each leg as the legs reach their fully deployed or outwardly canted position relative to the top sections of the table.

In a further variation of the fifth embodiment of the present invention, instead of utilizing stops mounted to each of the cables, separate reinforcing cable segments are provided which connect each leg diagonally to a portion of the tabletop spaced inwardly toward the inverted truss assembly such that the segments further prevent the outer pivotal movement of the legs with respect to the top sections when the table is in a fully deployed position.

It is the primary object of the present invention to provide improvements to portable tables which are particularly adapted for use for massage and other body therapy wherein the table legs and/or leg assemblies including longitudinal leg braces are reinforced by a cable truss system which includes diagonal cables for distributing stresses between the legs, and their affiliated braces, so as to provide both longitudinal and lateral stability for the tables when in use.

It is a further object of the present invention to provide cable truss systems for use in reinforcing foldable and portable tables of a type which are adapted for massage and other therapeutic uses wherein the cable truss systems provide for maximum leg clearance beneath the tables to thereby facilitate the free movement of therapists relative to the tables during use.

It is yet another object of the present invention to provide portable tables which are particularly adapted for massage and other body therapy which incorporate cable reinforcing truss systems for facilitating the automatic deployment of the legs when the tables are being readied for use.

BRIEF DESCRIPTION OF THE DRAWINGS

The present invention will be better understood with reference to the accompanying drawing wherein:

FIG. 8 is a bottom perspective view of a second embodiment of a portable therapy table in accordance with the teachings of the present invention;

FIG. 9 is a bottom plan view of the table of FIG. 8;

FIG. 11 is a bottom plan view of a third embodiment of the present invention;

FIG. 12 is an enlarged bottom plan view of an alternate attachment for some of the cable truss members of the embodiment of FIG. 11;

FIG. 15 is a bottom plan view of an alternate form of the embodiment of FIG. 11 incorporating an inverted guide truss for use with the cables of the cable truss system;

FIG. 16 is a bottom perspective view of a fourth embodiment of the present invention showing the table erected;

FIG. 19 is a bottom plan view of the variation shown in FIG. 17;

FIG. 20 is a cross-sectional view taken along line 20—20 of FIG. 19;

FIG. 21 is a partial cross-sectional view taken along line 21—21 of FIG. 19;

FIG. 22 is a bottom perspective view of a fifth embodiment of the present invention showing the table erected;

DESCRIPTION OF THE PREFERRED EMBODIMENTS

Figure 1:
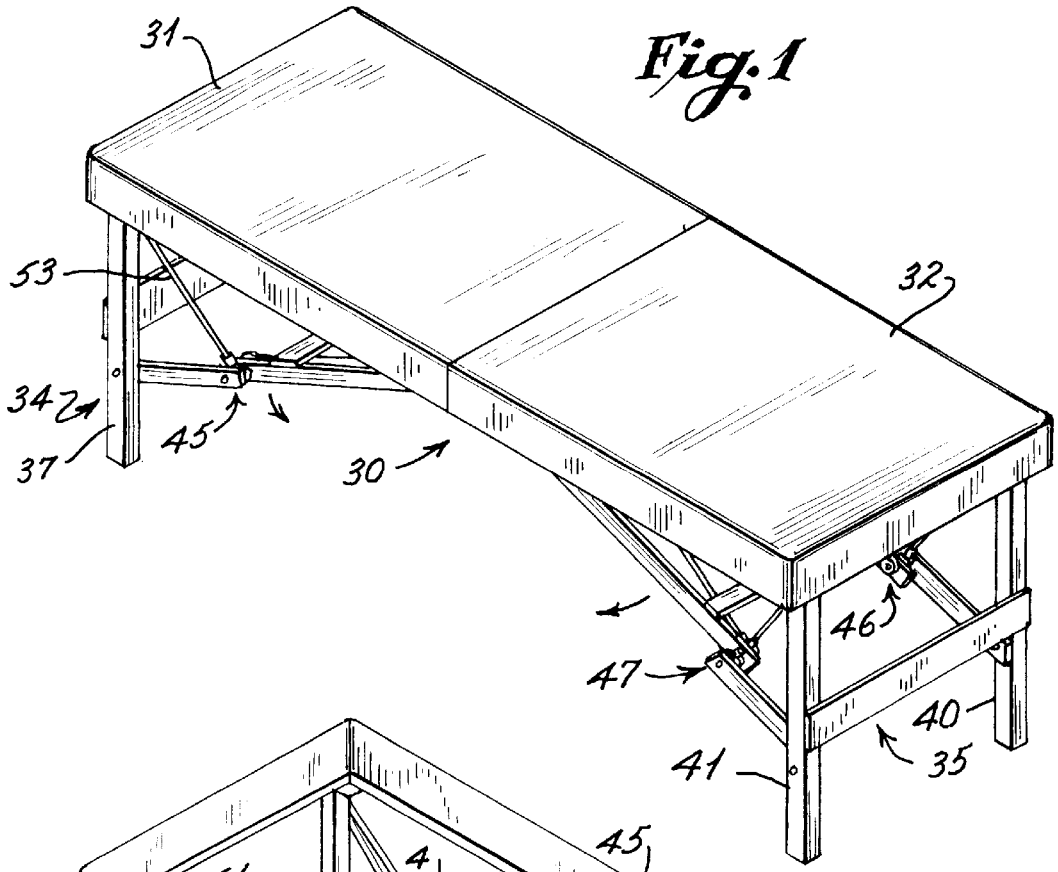
FIG. 1 is a top perspective view of a portable massage or physical therapy table in accordance with a first embodiment of the present invention shown in an erect configuration.

With continued reference to the drawing figures, FIGS. 1–3*a* illustrate a first embodiment of a portable folding table 30 suitable for massage and other body therapy which includes top sections 31 and 32 which are connected at a hinge joint 33. The hinge joint allows the top sections to be folded in the direction of the arrows shown in FIG. 1 so as to be compactly closed relative to one another for purposes of facilitating portability. Although not shown, an appropriate carrying handle is mounted along a side or end of the top sections. The upper and side portions of each of the top sections are covered with appropriate padding covered by a suitable fabric, leather, vinyl or the like. The top sections are supported by a pair of leg assemblies 34 and 35 which are designed to be pivoted to a stored position generally in parallel relationship with respect to the bottom of the table top sections 31 and 32 when the top sections are folded to a compact carrying configuration.

Figure 2:
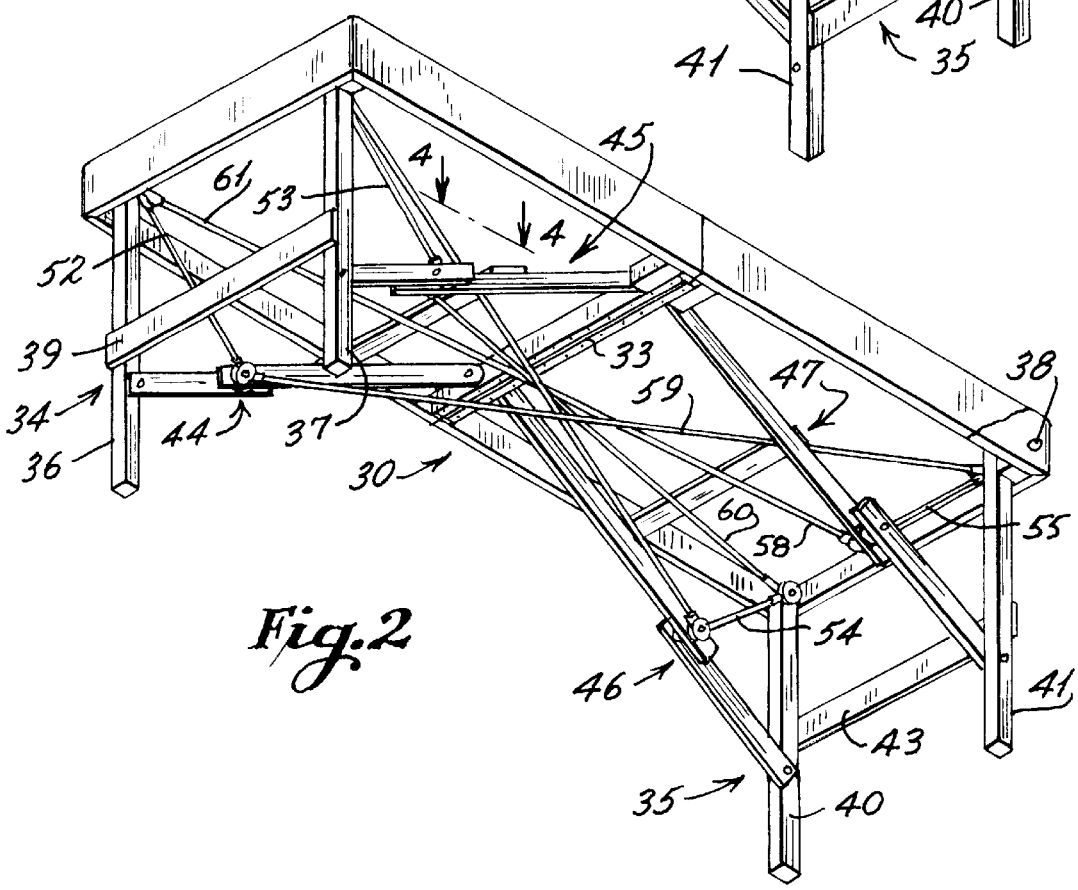
FIG. 2 is a bottom perspective view of the portable table of FIG. 1.

Leg assembly 34 includes corner legs 36 and 37, each of which is pivotally mounted at their upper ends to reinforcing blocks or to the corners of the table sections, such as illustrated at 38 in FIG. 2. The legs are connected by a cross-brace 39 which is secured intermediate the length of the legs. The cross-brace provides lateral stability when the table is in use. Leg assembly 35 includes legs 40 and 41 which are also pivotally mounted to reinforcing blocks or the corners of the table section and are also laterally stabilized by a cross-brace 43.

Each of the table legs is longitudinally stabilized by pivotable longitudinal braces 44–47, respectively. Each of the longitudinal braces includes segments 44A and 44B, 45A and 45B, 46A and 46B, and 47A and 47B which are pivotally connected at pivot joints 44C, 45C, 46C and 47C, respectively. The inner ends of each of the longitudinal braces are pivotally connected to reinforcing blocks adjacent the hinge joint 33 as shown at 44D, 45D, 46D and 47D. Additionally, the outer ends of the longitudinal braces are pivotally secured to longitudinally aligned legs at pivot joints 44E, 45E, 46E and 47E. The brace segments are thus pivotable relative to one another to a generally parallel relationship against the bottom of the top sections 31 and 32 when the table is folded into a compact configuration.

To further provide lateral stability to the longitudinal braces, each pair of the longitudinal braces 44–45 and 46–47 are connected by cross-braces 50 and 51.

The leg assemblies including their associated cross-braces and longitudinal braces, are designed to be deployed automatically when the table top sections are unfolded outwardly relative to one another. To accomplish this, in a first embodiment, an eight cable deployment and stabilization truss system is utilized. Unlike prior art cable truss systems, the cable truss system is designed to provide maximum clearance beneath the table so that a practitioner encounters less interference when moving about the table during performance of massage or other body therapy. In addition, the cable system of the present invention also provides unique diagonal and longitudinal stabilization for the leg assemblies.

Figure 3:
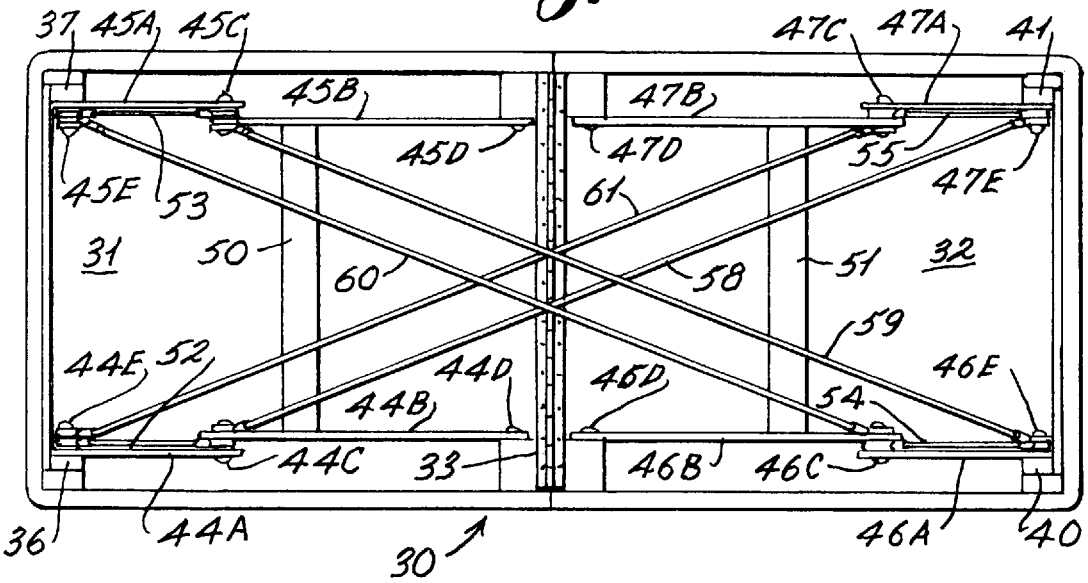
FIG. 3 is a bottom plan view of the portable table of FIG. 1.
Figure 4:
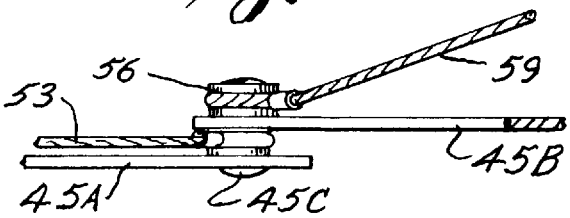
FIG. 4 is an enlarged partial cross-sectional view taken along line 4—4 of FIG. 2.
Figure 13:
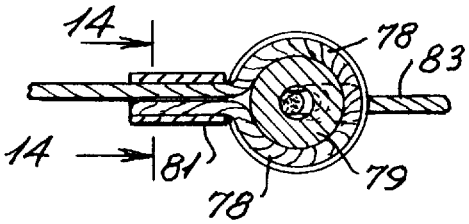
FIG. 13 is an enlarged cross-sectional view taken along line 13—13 of FIG. 12.
Figure 14:
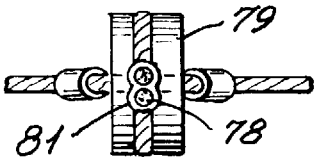
FIG. 14 is a cross-sectional view taken along line 14—14 of FIG. 13.

In this first embodiment, four short cables 52–55 are provided between the areas of each of the leg pivots at 44E, 45E, 46E and 47E and the adjacent longitudinal brace pivots 44C, 45C, 46C and 47C, respectively. As shown in FIG. 3, the cables 52–55 preferably extend intermediate each of the segments of the longitudinal braces with the free ends of each cable being wrapped around the pivot pins and crimped by suitable fasteners. With specific reference to FIG. 4, it is also possible that the short cables may be positioned around a spool element 56 associated with each pivot with the cable being positioned inside each of the segments of the longitudinal brace such as shown at 45A and 45B in FIG. 4. The length of each of the cables 52–55 is sufficient to allow each of the segments of the longitudinal braces to become longitudinally aligned with one another, as shown in FIG. 2, when the leg assemblies 34 and 35 are fully deployed. The cables 52–55 will effectively prevent movement of the leg assemblies outwardly relative to one another.

To provide further lateral and longitudinal stabilization, the present embodiment also provides for elongated cables which extend diagonally beneath the table, as shown clearly in FIGS. 2 and 3. In the first embodiment, the diagonally oriented cables are provided for stabilizing the longitudinal brace pivot points 44C, 45C, 46C and 47C. As shown, diagonal cable 58 extends from the pivot point or adjacent to the pivot point 44C to a diagonal remote end corner of the table adjacent to or at the pivot point 47E associated with leg 41. The ends of the diagonal cables may be secured by looping the cables about either grooved spools or pivot pins or by other suitable fasteners. The intermediate brace pivot joint 45C is further stabilized by extending cable 59 from the pivot point 45C or adjacent to the pivot 45C to the opposite diagonal corner area of the table adjacent the pivot point 46E associated with leg 40. Pivot joint 46C of longitudinal brace 46 is stabilized by cable 60 which extends diagonally therefrom to a remote end secured adjacent to a diagonal corner of the table adjacent the pivot point 45E associated with leg 37. Pivot point 47C of longitudinal brace 47 is further stabilized by extending a diagonal cable 61 therefrom to a remote corner of the table adjacent the pivot point 44E associated with leg 36.

It should be noted that although the diagonally extending cables are shown as being secured at the pivot points associated with the longitudinal braces, it is possible to connect the ends of the diagonal cables spaced from the pivot points. Utilizing the reinforcing cable configuration of the present embodiment, the diagonal cables cross at the center portion of the table so as to be spaced inwardly relative to the sides thereof. This relationship allows for more clearance along the sides of the table, thus reducing cable interference with a practitioner moving about the perimeter of the table during the application of massage or other body therapy. Further, the diagonal arrangement also provides increased lateral as well as longitudinal stability for the erected table.

Figure 5:
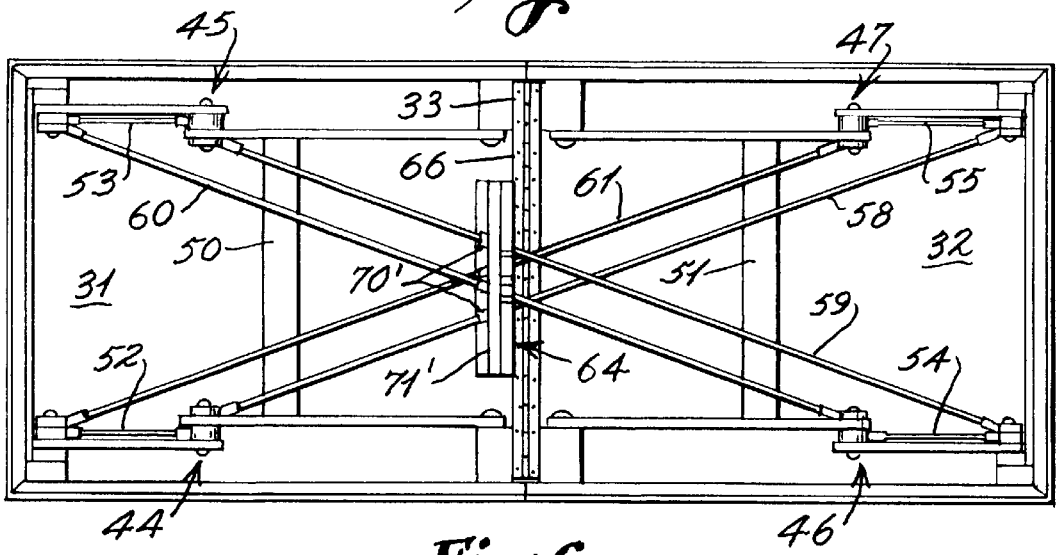
FIG. 5 is a bottom plan view of a modification of the embodiment shown in FIG. 1 incorporating a pivotable guide truss through which the reinforcing cables of the present invention pass beneath the bottom of the table.
Figure 6:
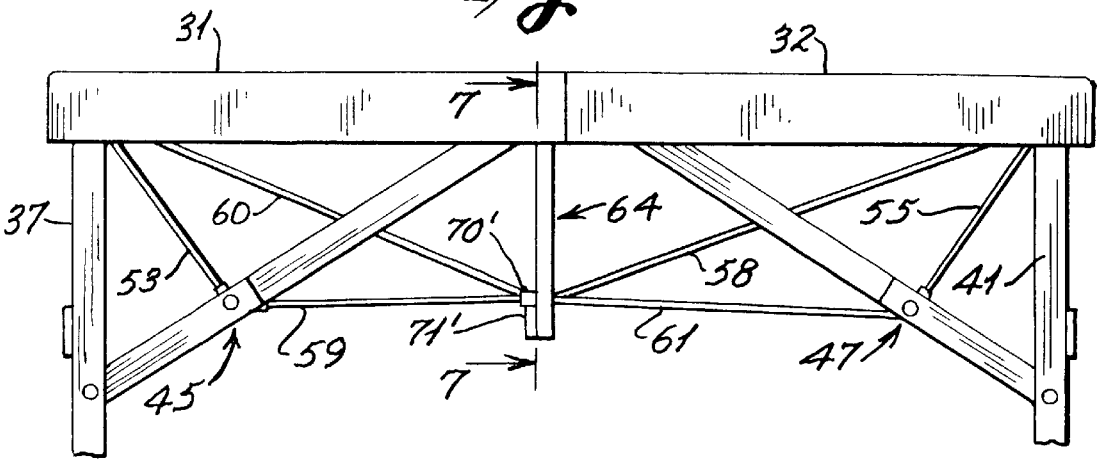
FIG. 6 is a side elevational view of the modified embodiment of FIG. 5.
Figure 7:
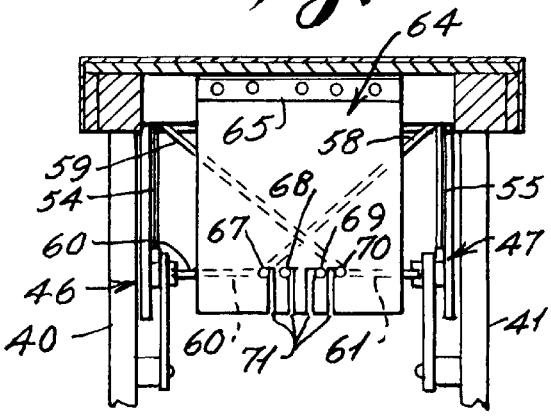
FIG. 7 is a cross-sectional view taken along line 7—7 of FIG. 6.
Figure 17:
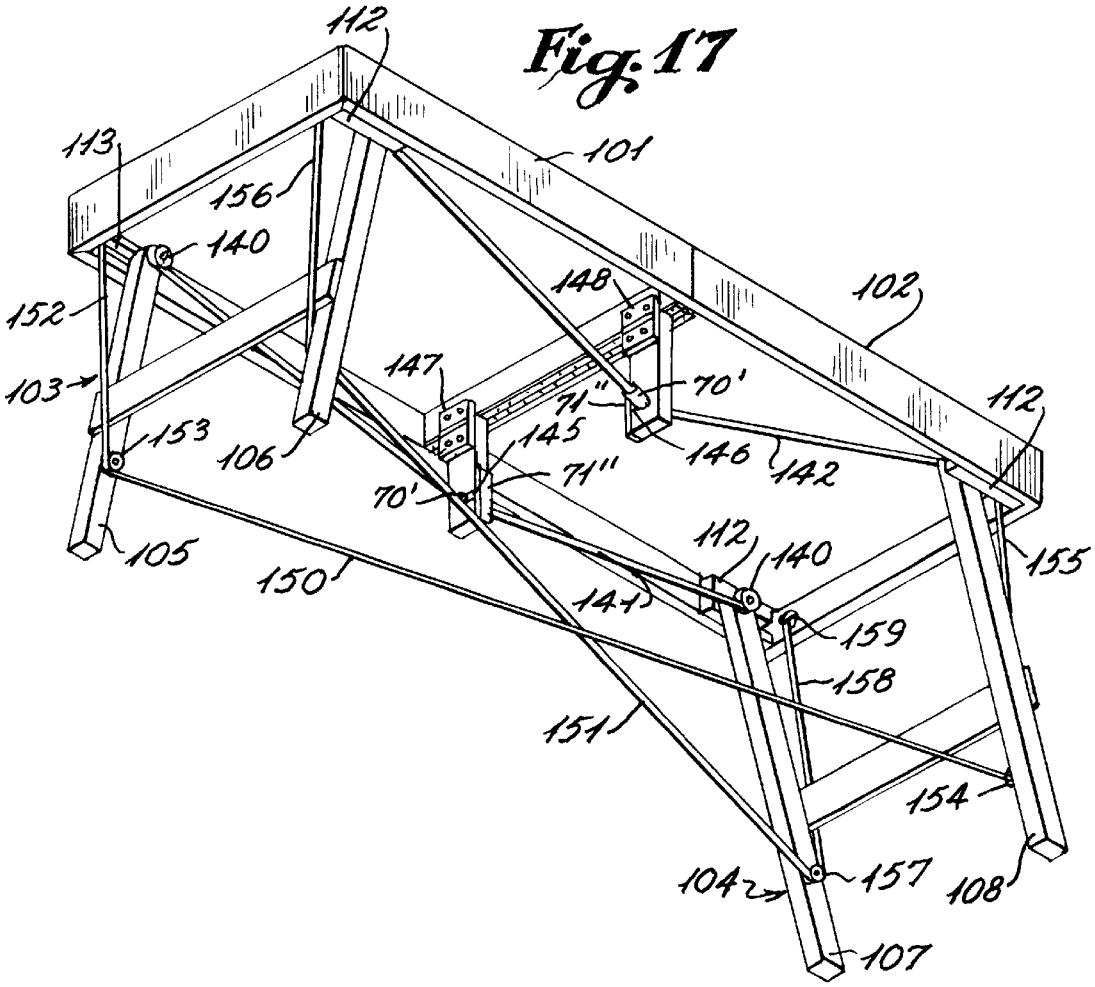
FIG. 17 is a bottom perspective view of a variation of the fourth embodiment of the present invention showing the table erected.
Figure 18:
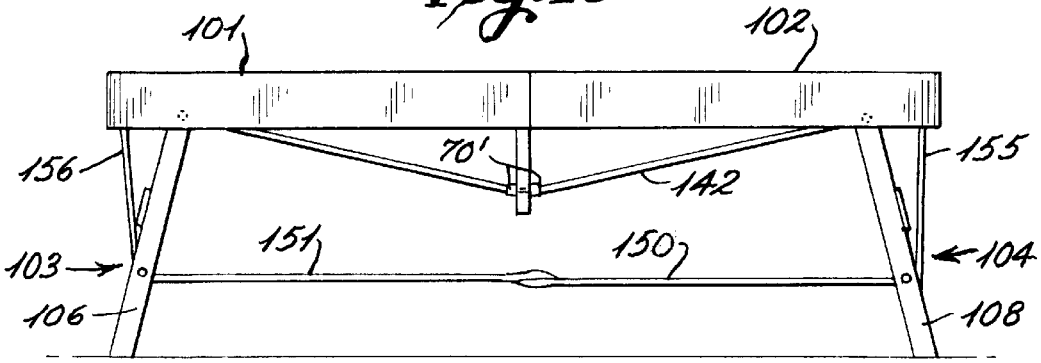
FIG. 18 is a side elevational view of the variation shown in FIG. 17.

With particular reference to FIGS. 5–7, a variation of the first embodiment of the first invention is disclosed in greater detail. In this embodiment, each of the elements of the table and the leg assemblies together with the cable truss system is identical to that previously described with respect FIGS. 1–4. However, in this embodiment, a center inverted guide truss 64 is hingedly mounted by hinge assembly 65 to an inner frame component 66 of table top section 31. The guide truss includes four spaced openings 67–70 through which the diagonal cables 58–61 extend. The openings are of a size to allow the cables to slide therethrough. Cable stops 70' are fixedly secured to each of the diagonal cables 58–61 and are spaced so as to engage the guide truss and pivot the truss from a closed position, in which the guide truss extends generally parallel to the top of the table, to a vertically deployed position, as shown in the drawing figures. To facilitate placement of the cables within the openings, offset slots 71 extend from the lower edge of the truss upwardly to the openings. A bar 71' is secured to the truss after the diagonal cables have been placed within the openings 67–70 to prevent the cables from becoming displaced from the openings. As shown in the drawing figures, diagonal cable 58 extends through opening 67, diagonal cable 59 extends through opening 70, diagonal cable 60 extends through opening 68 and diagonal cable 61 extends through opening 69. The guide truss will provide for further rigidity of the cable truss system and will also facilitate proper deployment of the cables as the table leg assemblies are deployed to the fully extended position as shown in FIGS. 5–7.

Figure 10:
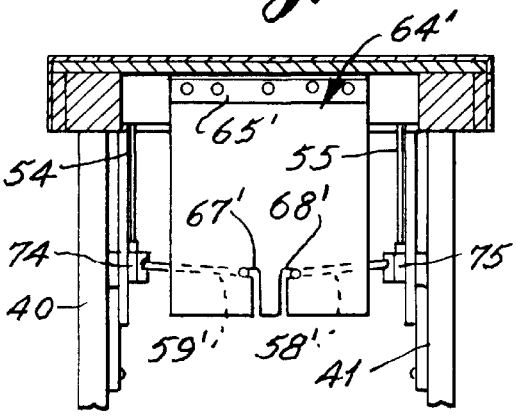
FIG. 10 is a cross-sectional view taken along line 10—10 of FIG. 9.

With reference to FIGS. 8–10, a second embodiment of the invention is shown wherein the elements of the table are the same as in the first embodiment including the leg assemblies and the cross and longitudinal braces and the short reinforcing cables 52–55. However, the short longitudinal reinforcing cables are shown as extending from the area of the pivot connection of each leg to a table top section end wall to an attachment point or spool adjacent to but spaced from the pivot joint of the adjacent longitudinal brace member as shown at 72, 73, 74 and 75. It should be noted, however, that the short cables may be secured to the pivot joints 44C–47C, as shown in the first embodiment.

In the second embodiment, each cable assembly includes two separate diagonally oriented cables 58' and 59' which are connected at their opposite ends to the longitudinal leg brace attachment points or support spools 72–75, respectively. The diagonal cables provide for maximum clearance beneath the table while also providing the desired diagonal reinforcement from the table legs. As opposed to separate short and diagonal cables, the short longitudinal cables at opposite corners of the table may be integrally formed with one of the diagonal cables with the segments of the cable being secured as previously discussed.

As with the first embodiment, this embodiment may also include or use an inverted guide truss 64' which is hingedly attached at 65' to an inner frame component 66 of one of the table top sections. The inverted truss, however, as shown in FIG. 10, only incorporates two cable guide openings 67' and 68' through which cables 58' and 59' extend. Cable stops 70' are fixed to the cables 58' and 59' and are positioned to engage the truss to pivot the truss from a closed to a deployed position as shown in FIG. 8. A bar 71' prevents the cables from being displaced from the openings 67' and 68'.

With specific reference to FIGS. 11–14, a third embodiment of the present invention is disclosed in greater detail. In this embodiment, the elements of the table are the same as in the previous embodiments, including the leg assemblies and the cross and longitudinal braces as well as the short reinforcing longitudinal cables 52–55. However, in FIG. 11, the short cables are also shown as extending between the leg pivot points 44E, 45E, 46E and 47E and the mounting spools 72, 73, 74 and 75, respectively, which are secured to the adjacent longitudinal braces spaced from the central pivot points, such as 44C. Although, the ends of the short cables which provide longitudinal stabilization for the leg braces could be positioned or connected at the pivot points for the longitudinal braces, such as shown in FIG. 12, where the short cables 52 and 53 are shown as being connected at the pivot points 44C and 45C.

In the present embodiment, cable clearance and lateral and longitudinal stabilization is provided between the braces 44–47 and 45–46, however, the transfer of stress and force is accomplished by using one or more longitudinal central cables 78 having opposite ends which extend about spaced spools 79 and 80 and which are secured thereto by fasteners 81 and 82. The spools 79 and 80 are hollow and allow passage of diagonally extending cables 83 and 84, respectively. Cable 83 extends from spool 72 (or pivot point 44C) diagonally toward the opposite end of the table and through spool 79 and thereafter back or rearwardly to the opposite connection or spool 73 (or pivot point 45C) located on the same end of the table. Cable 84 extends from spool 74 (or pivot point 46C) diagonally towards the opposite end of the table and through spool 80 and thereafter rearwardly to spool 75 (or pivot point 47C) located along the opposite side of the table section 12. Suitable stops 85 are secured on cables 83 and 84 and/or on both sides of the spools 79 and 80 to prevent the spools from shifting. As opposed to using single cables 83 and 84, it is possible that separate cables could be utilized to connect the brace members 44–45 and 46–47 to the central cable 78 at the spools 79 and 80.

With particular reference to FIG. 15, a bottom plan of a variation of the third embodiment is shown. In this embodiment, the components of the table and leg assemblies as well as the cable truss system are identical to those previously discussed and therefore the same numbers are used in the drawing figure. However, in this embodiment, an inverted guide truss 90 is pivotally mounted by hinge assembly to the end frame member 66 of table section 31. The truss includes a central opening therethrough similar to the openings 67–70 disclosed with respect to the embodiment shown in FIG. 7 through which the central cable 78 extends. A channel 92 communicates with the opening in the inverted truss member. The truss member functions in the same manner as the guide truss 64 discussed with the embodiment shown in FIGS. 5–7. A cable stop 70' is secured to cable 78 and is engageable with the truss to move the truss to the deployed position shown in FIG. 15. A bar 71' prevents the cable 78 from being displaced from the channel 92.

As with the previous embodiments, the embodiment shown in FIGS. 11–15 also results in less obstruction of the reinforcing cables beneath the table surface, thus reducing interference with a practitioner. In addition, the longitudinal and diagonal reinforcement of the leg assemblies and associated longitudinal braces provides additional rigidity for the table.

With specific reference to FIG. 16, a fourth embodiment of the present invention is disclosed. In this embodiment, the portable table 100 includes table top sections 101 and 102 which are hingedly connected with respect to one another in the same manner as discussed in previous embodiments. The table top sections include the same padding provided for personal comfort. Unlike the first three embodiments, the present embodiment includes leg assemblies 103 and 104 which are not reinforced by longitudinal braces. Each of the leg assemblies 103 and 104 includes separate legs 105, 106, 107 and 108, respectively, which are reinforced laterally by cross braces 109 and 110. The leg assemblies are designed to be pivotally moveable from a stored position in generally parallel relationship beneath the table sections 101 and 102 to a fully deployed or extended position as shown in FIG. 16 by being pivotally and slidably mounted at their upper ends within guide blocks 112. Each of the guide blocks is secured adjacent an outer end corner of the table top sections and includes a recess or slot 113, see FIG. 21, which receives a guide bar, roller, pin, or similar member 115. In FIG. 16, each guide bar or pin 115 is shown as extending across and through the upper ends of each pair of the legs 105–106 and 107–108. As opposed to having the bar extending across and through each of the upper ends of the legs, shorter guide pins, such as shown in FIG. 20, may be utilized to track within the recess, slot or channel 113 of each of the guide blocks 112. The recesses may be formed with an outer depending flange in which a roller or other device connected to the upper portion of the legs may be cooperatively received. The channel 113 thus allows a longitudinal movement of each leg while also permitting a pivotal movement of the lower leg relative to the top sections of the table. When the guide bars or pins engage a wall defining the front of the recesses, further longitudinal movement of each leg is prevented, thus providing longitudinal reinforcement for the leg in place of the longitudinal braces discussed with respect to the previous embodiments. As further shown in FIG. 16, in a fully deployed position, each of the legs is canted outwardly relative to a vertical plane at an angle such that any stress applied along the leg is directed to the guide blocks 112, thus providing stability for the leg assemblies when the table is in use.

As with the previous embodiments, the embodiment of FIG. 16 also includes cable segments which extend from an end secured at each outer corner of the table top sections downwardly to a point along the length of each leg. However, in this embodiment, such cable segments are part of a longer cable which also extends diagonally from the leg to a point of attachment to the guide member 115, or other guide mechanism, associated with the upper portion of each leg. In the drawing figure, cable 116 includes a short vertical segment 117 which extends from a corner of the table downwardly to a point 118 spaced below the cross brace 109 of the leg assembly 103. Thereafter, the cable 116 extends diagonally to a point of attachment with the guide member 115 adjacent the upper portion of leg 108. In a similar manner, cable 120 includes a shortened vertical segment 121 which is attached at a corner of the table adjacent the upper end of the leg 106 with the cable extending downwardly and is secured along the leg 106 below the cross brace 109. Thereafter, cable 120 extends to a point of attachment 122 to the opposite guide member 115. Cable 124 includes a vertical segment 125 which is secured to an end portion of table section 102 adjacent the outer corner thereof, and extends downwardly to a point 126 and is secured to leg 107 below the cross brace 110. Thereafter, cable 124 extends diagonally to a point of attachment (not shown) with guide member 115 associated with leg 106. Cable 128 includes a vertical segment 129 which extends from a corner of table top section 102 downwardly to a point 130 and is mounted to leg 108 below the cross brace 110 and thereafter the cable extends diagonally to a point of attachment 132 to the guide rod 115 adjacent the upper portion of leg 105.

Utilizing the cable truss assembly of this embodiment, it will be noted that, as the leg assemblies 103 and 104 are unfolded relative to the table top sections 101 and 102, the diagonally extending cables will pull the upper portion of the legs relative to the guide channels 113, thus automatically deploying the leg assemblies to the position shown in FIG. 16. The diagonal segments of each leg will further provide lateral as well as longitudinal stability for the leg assemblies when the table is erect. To further provide guidance and to assist in deployment of the leg assemblies by the cables when the leg assemblies are unfolded, the present embodiment may also incorporate a downwardly extending guide truss 135 which is hingedly mounted at 136 to an inner end wall 137 of table top section 101. As with the previous embodiments incorporating guide trusses, the guide truss is moveable from a storage position generally parallel with respect to the top section 101 to a vertically deployed position as shown in FIG. 16. The guide truss 135 includes a T-shaped slotted opening 138 which receives the diagonally crossing cables 116, 120, 124 and 128. The diagonally crossing cables are retained within the slotted opening 138 by a bar 71'. Cable stops 70' are secured to the cables so as to engage the truss and move to the deployed position.

With particular reference to FIGS. 17–21, a variation of the fourth embodiment of the present invention is disclosed in greater detail. In this variation, the table leg assemblies are the same as disclosed in FIG. 16, however, the upper portions of the legs are shown as being guided within the guide channels by short guide pins 140 which do not extend between the upper portions of the legs of each leg assembly. The portions of the table which are the same as the table in FIG. 16 have the same reference numbers.

In the present variation, the automatic deployment of the leg assemblies is accomplished by extending a pair of generally parallel cables 141 and 142 between each of the guide pins 140 associated with the upper portions of the legs 105–108. The parallel cables extend through a pair of spaced inverted truss members 143 and 144 having slots 145 and 146 through which the cables extend. The guide trusses are pivotally mounted at 147 and 148 to the inner end wall 137 of table top section 101. In this variation, the cables 141 and 142 are designed to be somewhat resilient so that they are stretchable when deployed to the position shown in FIG. 17. Because of the stretching of the parallel cables, a positive force is applied to urge the upper portion of each of the legs on either side of the table toward one another so as to abut the inner end walls defining the channels 113 within the guide blocks 112. The cables 141 and 142 are fixed relative to the truss members 143 and 144, respectively, by providing cable stops 70' on each side of the trusses. Bars 71" are provided to prevent the cables from being displaced from the slots 145 and 146.

In the present alternative embodiment, the number of diagonally extending cables may be reduced as it is not necessary to have these cables perform the function of deploying the leg assemblies as with the embodiment shown in FIG. 16. Therefore, in the present alternative embodiment, two elongated crossing cables 150 and 151 are used to provide lateral and longitudinal stabilization for the leg assemblies. Cable 150 includes a vertically extending segment 152 which is secured at an upper corner of table top section 101 and extends downwardly to a point where it mounts to leg 105 below the cross brace 109. The cable thereafter extends diagonally to point 154 where it mounts to leg 108 beneath the cross brace 110. Thereafter, cable 150 includes a second vertical segment 155 which is secured in the area of the corner of table top section 102 adjacent the upper portion of leg 108. In a similar manner, cable 151 includes a first vertical portion 156 which is anchored to an area adjacent the upper portion of leg 106 or to table top section 101 and extends downwardly to a point (not shown) and mounts below the cross brace 109 of table leg 106. Thereafter, the cable extends diagonally to a point 157 where it mounts to the lower portion of leg 107 below the cross brace 110. The cable 151 also includes a second vertically extending segment 158 secured at 159 at a corner of the table top section 102.

With particular reference to FIG. 22, a fifth embodiment of the present invention is shown. In this embodiment, the table 160 which is generally similar in structure to the previous embodiment, including table top sections 161 and 162 which are padded and covered for personal comfort and which are connected by a central hinge 163. The top sections are supported by leg assemblies 164 and 165. Leg assembly 164 includes legs 166 and 167 which are reinforced by a cross brace 170. Leg assembly 165 includes legs 168 and 169 which are reinforced by a cross brace 171. In the present embodiment, the legs are pivoted at their upper ends such as about pivot points 172 relative to stop blocks 174 mounted adjacent the upper ends of each leg. As particularly shown in FIG. 23, the upper end of each leg includes a generally planar face 175 which is designed to abut the stop blocks 174 when the leg assemblies are in a fully deployed position. In the fully deployed position, the legs will be canted outwardly relative to a vertical plane extending through each pivot point 172 such that any force directed along the legs is applied to both the pivot point 172 and to the interface between the face 175 of the upper portion of the leg and the adjacent stop block 174.

In the embodiment shown in FIG. 22, the cable truss for providing both longitudinal and lateral reinforcement for the leg assemblies includes four elongated cables, each having a vertical segment and a diagonally extending segment. As shown, cable 180 includes a vertical segment 181 which is anchored at its end at 182 to leg 166 spaced below the cross brace 170. Cable 180 extends from the vertical segment 181 upwardly about a guide pulley 184 mounted to the corner of the table section 161. Thereafter, cable 180 extends diagonally to an anchor point 185 along leg 169 spaced below the cross brace 171. Cable 186 includes a vertically extending segment 187 which is anchored at 188 to a portion of leg 167 below the horizontal cross brace 170. The cable extends over a pulley 188' mounted to a corner of the table top section 161 and thereafter extends diagonally to an anchor point 189 along the leg 168 spaced below the cross brace 171. Cable 190 includes a vertically extending segment 191 which is anchored at point 189 and which extends over a pulley 192 mounted adjacent the corner of table top section 162. Thereafter, cable 190 extends diagonally to anchor point 188 along leg 167. The fourth cable 194 of the cable truss system of the present embodiment includes a vertical segment 195 which is anchored at one end to anchor point 185 and extends upwardly about a pulley 196 mounted to a corner of the tabletop section 162. Thereafter, the cable extends diagonally to anchor point 182 along leg 166.

In the present embodiment, an inverted guide truss 198 is hingedly mounted at 199 to table top section 161 so as to moveable from a storage position horizontally beneath the table top section to a deployed position, as shown in FIG. 22. The guide truss 198 includes a plurality of slots 200 through which the diagonally extending portions of the cables extend as shown in the drawing figures. The cables are retained in the slots 200 by a bar 71' which is secured to the truss 198. Cable stops 70' are secured to the cables on opposite sides of the truss to thereby fix the cables relative to the truss to assist in moving the truss to the deployed position.

Figure 23:
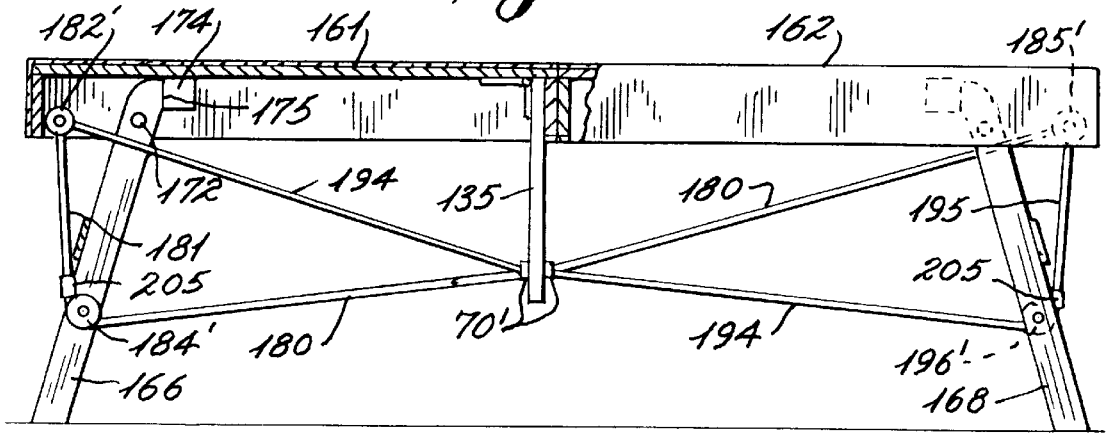
FIG. 23 is a side elevational view having portions broken away of a variation of the fifth embodiment of the present invention.
Figure 24:
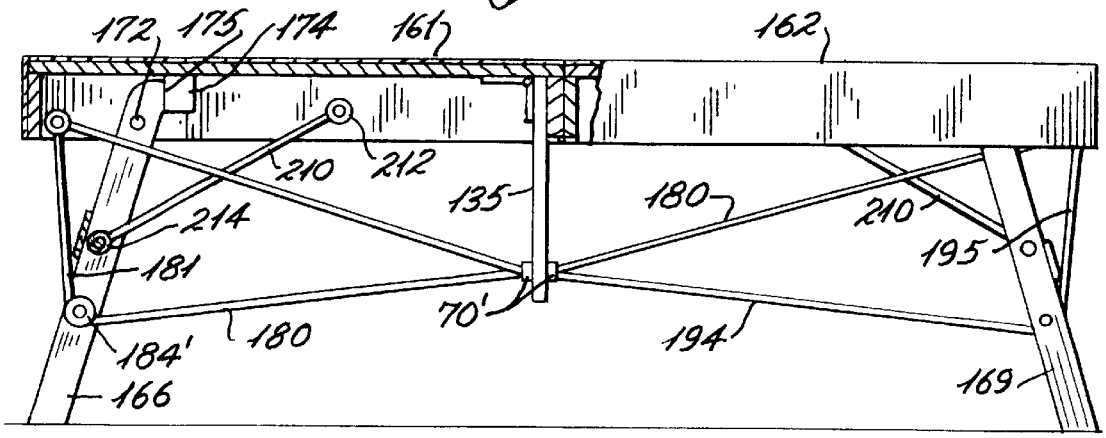
FIG. 24 is a side elevational view having portions broken away of another variation of the embodiment shown in FIG. 22.

With specific reference to FIGS. 23 and 24, alternate variations of the embodiment of FIG. 22 are disclosed. In these variations, the components of the table including the leg assemblies are the same as described with respect to FIG. 22 and therefore the same reference numbers are utilized. In these embodiments, however, there is a slight variation in the cable truss system. In each variation, the same four long cables are utilized as described in FIG. 22 with the exception that the points of connection are modified such that the cables are secured at their free ends to anchor points which are provided at the upper outer corners of the table top sections 161 and 162, as opposed to being anchored to a portion of the legs as discussed in the embodiment of FIG. 22. In FIG. 23, the fixed point of attachment for cables 180 and 194 are shown at 182'. The cable segments 181 is shown as passing around a pulley 184' secured to the leg 166 after which the cable 180 extends diagonally to an opposite upper corner of the table. The cable 194 is anchored at fixed point 182' and extends diagonally to a pulley 196' provided along leg 168 after which the cable extends upwardly to a fixed point 185' at a corner of the table top section 162. Cables 186 and 190 are also similarly oriented and guided with respect to the table sections. To provide further positive rigidity for the table assemblies when in the fully deployed position, as shown in FIG. 23, stop members 205 are secured to each of the vertically extending portions of the cables 180, 186, 190 and 194 so as to engage the guide pulleys, such as shown at 184' and 196', to thereby prevent further movement of the legs when the stops engage the pulleys.

With specific reference to FIG. 24, as opposed to utilizing the cable stops 205 shown in FIG. 23. Separate cables 210 may be utilized as positive stops to limit the degree of deployment of leg assemblies when the table is fully erected. As shown, four such cable segments 210 are utilized. Each cable is secured to a side wall of the table top sections 161 and 162 spaced from end walls thereof, such as shown at 212 in the drawing figures, to another fixed point 214 provided along the length of each of the legs, such as shown at 166 and 169 in the drawing figures.

Although not shown in the drawings, each of the embodiments of the present invention may include legs which are vertically adjustable to regulate the height of the tables.

The foregoing description of the preferred embodiments of the invention has been presented to illustrate the principles of the invention and not to limit the invention to the particular embodiments illustrated. It is intended that the scope of the invention be defined by all of the embodiments encompassed within the following claims and any and all equivalents thereof.

We claim:

1. A portable foldable table adapted for use for massage and other body therapy, comprising:

first and second table top sections having inner and outer ends, and means for hingedly connecting said inner ends of said first and second table top sections to one another whereby said first and second table top sections may be folded in overlying relationship relative to one another, each of said outer ends defining first and second spaced corners, first and second leg assemblies, each including first and second legs pivotally mounted at first and second pivot points adjacent said first and second spaced corners of said first and second table top sections, respectively, said first leg of said first leg assembly being oriented generally diagonally with respect to said first leg of said second leg assembly and said second leg of said first leg assembly being oriented generally diagonally with respect to said second leg of said second leg assembly, each of said leg assemblies including means for limiting the pivotal movement of said first and second legs relative to said first and second table top sections as said legs are moved from a first stowed position beneath said first and second table top sections to a deployed position when the table is erect, and a cable stabilization system including at least two diagonally oriented cable segments extending between said first and second leg assemblies beneath said first and second table top sections and at least two longitudinal cable segments extending from adjacent said outer ends of each of said first and second sections vertically downwardly to said first and second leg assemblies, respectively.

2. The portable table of claim 1 including at least one inverted guide truss mounted beneath said first and second table top sections, said at least two diagonal cable segments extending through said at least one guide truss.

3. The portable table of claim 1 in which each of said first and second leg assemblies includes a pair of longitudinal braces, each having an inner segment pivotally connected to said first and second table top sections in spaced relationship with respect to said first and second legs thereof and an outer segment pivotally connected to the first and second legs, and a pivot joint connecting each of said first and second segments.

4. The portable table of claim 3 in which one of said longitudinal cable segments extends from adjacent said first pivot point of each of said first legs of said first and second table top sections to said pivots joints of said longitudinal braces associated with said first legs and one of said longitudinal cable segments extends from adjacent said second pivot point of each of said second legs of said first and second table top sections to said pivot joints of said longitudinal braces associated with said second legs.

5. The portable table of claim 4 including at least four diagonal cable segments extending and crossing with one another beneath said first and second table top sections, a separate one of said diagonal cable segments being secured in an area of said pivot joint of one of said longitudinal braces and adjacent a diagonally oriented one of said first and second spaced first and second table top sections.

6. The portable table of claim 5 including at least one inverted guide truss mounted beneath said first and second table top sections, said at least four diagonal cable segments extending through said at least one guide truss.

7. The portable table of claim 4 including at least two diagonal cable segments extending and crossing with one another beneath said first and second table top sections, said diagonal cable segments extending between and being secured in an area of said pivot joints of diagonally oriented longitudinal braces of said first and second leg assemblies.

8. The portable table of claim 6 including at least one inverted guide truss mounted beneath said first and second table top sections, said at least four diagonal cable segments extending through said at least one guide truss.

9. The portable table of claim 1 including at least one longitudinally extending center cable having opposite ends, means for connecting one of said opposite ends to a first of said diagonal cable segments and means for connecting the second of said opposite ends to a second of said diagonal cables, said first diagonal cable segment having a first end connected to a longitudinal brace associated with said first leg of said first leg assembly and a second end connected to a longitudinal brace associated with said second leg of said first leg assembly, and said second diagonal cable segment having a first end connected to a longitudinal brace associated with said first leg of said second leg assembly and a second end connected to a longitudinal brace associated with said second leg of said second leg assembly.

10. The portable table of claim 9 wherein each of said means for connecting said opposite ends of said center cable to said first and second diagonal cable segments includes a spool having an opening therethrough and means for mounting said opposite ends of said center cable about said spools, and each of first and second diagonal cable segments extending through said openings in said pools.

11. The portable table of claim 10 including at least one inverted guide truss mounted beneath said first and second table top sections, said center cable extending through said at least one guide truss.

12. The portable table of claim 1 in which said means for limiting the pivotal movement of said legs relative to said first and second table top sections includes a guide track mounted adjacent each of said first and second corners of said first and second table top sections, means for guidingly engaging an upper portion of each of said first and second legs of each of said first and second leg assemblies within said guide tracks whereby said upper portions of each of said first and second legs are slidable and pivotal relative to said guide tracks.

13. The portable table of claim 12 including four of said diagonal cable segments extend diagonally beneath said first and second table top sections from adjacent a lower portion of each of said first and second legs of said first and second leg assemblies to a connection adjacent an upper end of said first and second legs of an opposite of said first and second leg assemblies whereby said diagonal cable segments urge said upper portion of said leg assemblies to slide within said guide tracks to thereby engage a stop wall associated with said guide tracks to retain said legs in a canted position relative to said first and second table top sections when said table is erect.

14. The portable table of claim 13 wherein each of said vertical segments is integrally formed with one of said diagonal cable segments.

15. The portable table of claim 13 including at least one inverted guide truss mounted beneath said first and second table top sections, said diagonal cable segments extending through said at least one guide truss.

16. The portable table of claim 1 wherein each of said means for limiting the pivotal movement of said first and second legs relative to said first and second table top sections includes a longitudinally extending guide means mounted adjacent each of said first and second corners of said first and second table top sections, guide means extending from an upper portion of each of said first and second legs of said first and second leg assemblies and slidably engageable with said guide elements, a pair of parallel longitudinally extending cables, one of said longitudinally extending cables extending from adjacent said guide means of said first leg of said first leg assembly to adjacent said guide means of said first leg of said second leg assembly and the other of said longitudinal cables extending between said guide means of said second leg of said first leg assembly to said guide means of said second leg of said second leg assembly, said longitudinally extending cables being operable to urge said guide means of each of said first and second legs forwardly into abutment with a stop associated with each of said guide means.

17. The portable table of claim 16 including at least one inverted guide truss mounted beneath said first and second table top sections, said pair of longitudinally extending cables extending through said at least one guide truss.

18. The portable table of claim 16 in which two of said longitudinal cable segments and one of said diagonal cable segments are formed as an integral cable, one of said integral cables extending from each of said first and second corners of said first top section vertically downwardly to guide means associated with said first and second legs of said first leg assembly and extending diagonally beneath said first and second table top sections to second guide means associated with the first and second legs of said second leg assembly and subsequently, vertically upwardly to points of attachment adjacent said first and second corners of said second table top section.

19. The portable table of claim 1 in which said means for limiting the pivotal movement of said legs relative to said first and second table sections includes a stop member mounted adjacent an upper end portion of each of said first and second legs of said first and second leg assemblies, each of said first and second legs having an abutment face for engaging said stop members when said first and second legs are pivoted to a deployed position.

20. The portable table of claim 19 in which each of said longitudinal cable segments extends from a point of attachment at one end to one of said first and second legs of one of said first and second leg assemblies upwardly about a guide means secured to an adjacent one of said first and second corners of one of said first and second table top sections and said diagonal cable segments extending from each of said guide means diagonally downwardly to a point of attachment with a diagonal one of said first and second legs of an opposite one of said first and second leg assemblies.

21. The portable table of claim 20 wherein each one of said longitudinal cable segments is integrally formed with one of said diagonal cable segments.

22. The portable table of claim 20 including a brace cable mounted to each of said first and second legs and extending diagonally from each of said first and second legs to an adjacent one of said first and second table top sections.

23. The portable table of claim 19 in which each of said longitudinal cable segments have a first end mounted to one of said first and second corners of one of said first and second table top sections and extend about a guide means associated with an adjacent one of said first and second legs and a diagonal cable segment extending from each of said guide means diagonally beneath the table to a point of attachment at a diagonal one of said first and second corners of the other of said first and second table top sections.

24. The portable table of claim 23 wherein each one of said longitudinal cable segments is integrally formed with one of said diagonal cable segments.

25. The portable table of claim 23 including a brace cable mounted to each of said first and second legs and extending diagonally from each of said first and second legs to an adjacent one of said first and second table top sections.

* * * * *